US009313588B2

(12) United States Patent
Gebert et al.

(10) Patent No.: US 9,313,588 B2
(45) Date of Patent: Apr. 12, 2016

(54) MOLDING STRUCTURE FOR A HEARING APPARATUS, HEARING APPARATUS, AND METHOD OF PRODUCING THE MOLDING STRUCTURE

(71) Applicant: SIVANTOS PTE. LTD., Singapore (SG)

(72) Inventors: Anton Gebert, Kleinsendelbach (DE); Stefan Kexel, Nuremberg (DE); Frank Rosenberger, Erlangen (DE); Benjamin Schmidt, Nuremberg (DE); Christian Weistenhoefer, Bubenreuth (DE)

(73) Assignee: Sivantos Pte. Ltd., Singapore (SG)

( * ) Notice: Subject to any disclaimer, the term of this patent is extended or adjusted under 35 U.S.C. 154(b) by 329 days.

(21) Appl. No.: 13/857,297

(22) Filed: Apr. 5, 2013

(65) Prior Publication Data

US 2013/0223665 A1 Aug. 29, 2013

Related U.S. Application Data

(63) Continuation-in-part of application No. 13/541,908, filed on Jul. 5, 2012, now abandoned.

(30) Foreign Application Priority Data

Jul. 5, 2011 (DE) ..... 10 2011 078 675

(51) Int. Cl.
*H04R 25/00* (2006.01)

(52) U.S. Cl.
CPC ..... *H04R 25/652* (2013.01); *H04R 25/65* (2013.01); *H04R 25/658* (2013.01); *H04R 2225/023* (2013.01); *H04R 2460/17* (2013.01)

(58) Field of Classification Search
CPC ..... H04R 25/00; H04R 1/02; H04R 25/652; H04R 25/658; H04R 25/65; H04R 2225/023; H04R 2460/17
USPC ..... 381/328, 71.7, 380; 264/222; 425/2
See application file for complete search history.

(56) References Cited

U.S. PATENT DOCUMENTS

| | | | |
|---|---|---|---|
| 4,834,927 | A | 5/1989 | Birkholz et al. |
| 4,871,502 | A | 10/1989 | LeBisch et al. |
| 5,321,757 | A | 6/1994 | Woodfill, Jr. |
| 5,440,082 | A | 8/1995 | Claes |

(Continued)

FOREIGN PATENT DOCUMENTS

| | | | | |
|---|---|---|---|---|
| DE | 102006004033 | * | 8/2007 | ..... H04R 25/60 |
| EP | 0245741 | A1 | 11/1987 | |

(Continued)

*Primary Examiner* — Davetta W Goins
*Assistant Examiner* — Oyesola C Ojo
(74) *Attorney, Agent, or Firm* — Laurence A. Greenberg; Werner H. Stemer; Ralph E. Locher

(57) ABSTRACT

Hearing apparatuses should be manufactured as simply as possible and with the closest possible fit. Accordingly, a molding structure is provided, which represents a model for the direct shaping of an otoplastic of a hearing apparatus. The molding structure has a sealing element, which can be positioned in the auditory canal. A molding mass is inserted into the auditory canal to a side of the sealing element facing the outlet of the auditory canal. The molding mass and the sealing element here are connected to form the model of the hearing apparatus and the sealing element has the exact shape of a part of the hearing apparatus.

8 Claims, 2 Drawing Sheets

(56) References Cited

U.S. PATENT DOCUMENTS

| | | | | |
|---|---|---|---|---|
| 5,455,994 | A | 10/1995 | Termeer et al. | |
| 5,804,109 | A * | 9/1998 | Perkins | H04R 25/652 264/222 |
| 6,097,826 | A | 8/2000 | Clavadetscher et al. | |
| 6,205,227 | B1 | 3/2001 | Mahoney et al. | |
| 6,339,648 | B1 | 1/2002 | McIntosh et al. | |
| 7,467,022 | B2 * | 12/2008 | Bhagwat | H04R 25/658 381/312 |
| 8,032,337 | B2 | 10/2011 | Deichmann et al. | |
| 2008/0137892 | A1 * | 6/2008 | Shennib | H04R 25/60 381/328 |
| 2010/0027825 | A1 * | 2/2010 | Fickweiler | H04R 25/60 381/330 |

FOREIGN PATENT DOCUMENTS

| | | | |
|---|---|---|---|
| EP | 0821542 | A2 | 1/1998 |
| EP | 2152025 | A1 | 2/2010 |

* cited by examiner

MOLDING STRUCTURE FOR A HEARING APPARATUS, HEARING APPARATUS, AND METHOD OF PRODUCING THE MOLDING STRUCTURE

CROSS-REFERENCE TO RELATED APPLICATION

This is a continuation-in-part (CIP) of copending patent application Ser. No. 13/541,908, filed Jul. 5, 2012; the application further claims the priority, under 35 U.S.C. §119, of German patent application DE 10 2011 078 675.9, filed Jul. 5, 2011; the prior applications are herewith incorporated by reference in their entirety.

BACKGROUND OF THE INVENTION

Field of the Invention

The present invention relates to a molding structure, which represents a model for the direct shaping of an otoplastic for a hearing apparatus. The present invention also relates to a hearing apparatus, which can be worn in an auditory canal. Finally the present invention relates to a method for adjusting a molding structure, which represents a model for the direct shaping of an otoplastic for a hearing apparatus.

Hearing devices are hearing apparatuses which can be worn and which are used to assist people with impaired hearing. To meet the many different individual needs, different models of hearing devices are available, such as behind the ear hearing devices (BTE), hearing devices with an external earpiece (RIC: receiver in the canal) and in the ear hearing devices (ITE), for example also concha hearing devices or canal hearing devices (ITE, CIC). The hearing devices listed as examples are worn on the outer ear or in the auditory canal. However bone conduction hearing aids, implantable or vibrotactile hearing aids are also available commercially. With these the damaged hearing is stimulated either mechanically or electrically.

The key components of hearing devices are in principle an input transducer, an amplifier and an output transducer. The input transducer is generally a sound receiver, e.g. a microphone, and/or an electromagnetic receiver, e.g. an induction coil. The output transducer is generally implemented in the form of an electroacoustic converter (e.g., a miniature loudspeaker) or as an electromechanical converter (e.g., a bone conduction earpiece). The amplifier is generally integrated in a signal processing unit. This basic structure is illustrated in FIG. 1 using the example of a behind-the-ear (BTE) hearing device. Incorporated in a hearing device housing 1 to be worn behind the ear are one or more microphones 2 for picking up sound from the environment. A signal processing unit 3, which is likewise integrated in the hearing device housing 1, processes the microphone signals and amplifies them. The output signal of the signal processing unit 3 is transmitted to a loudspeaker or earpiece 4, which outputs an acoustic signal. In some instances the sound is transmitted by way of a sound tube, which is secured with an otoplastic in the auditory canal, to the eardrum of the device wearer. Energy is supplied to the hearing device and in particular to the signal processing unit 3 by a battery 5 likewise integrated in the hearing device housing 1.

Canal hearing devices (CIC) are generally positioned within the auditory canal. If the fit of such hearing devices is not tailored ideally to the auditory canal, an unwanted occlusion signal can be produced. To prevent such an occlusion signal, the hearing device or parts of the hearing device with a sound output function is/are positioned as deeply as possible within the auditory canal. To prevent a feeling of discomfort or even possible pain when wearing the hearing device, the hearing device or the corresponding parts of the hearing device must be matched particularly accurately to the auditory canal of the hearing impaired person. To this end a molding structure of the auditory canal is generally supplied, being captured using a 3D scanner. The data captured using the scanner can be used to produce corresponding molds, known as otoplastics.

In order to be able to produce a corresponding molding structure, a corresponding piece of cotton wool or foam is inserted into the bony part of the auditory canal. The inserted material prevents the molding mass coming into contact with the eardrum or damaging the eardrum. An appropriate molding mass, for example an appropriate silicone material, is then inserted into the auditory canal in the liquid state and allowed to harden.

U.S. Pat. No. 6,339,648 B1 describes an apparatus, which can be inserted into the auditory canal. This apparatus is enclosed in a corresponding sheath. This allows an appropriate molding mass to be inserted into the space between the apparatus and the sheath, thereby producing an exact molding structure of the auditory canal.

SUMMARY OF THE INVENTION

It is accordingly an object of the invention to provide a molding structure for a hearing apparatus, a hearing apparatus and a method for producing the molding structure which overcome the above-mentioned disadvantages of the prior art methods and devices of this general type, which allows an exact fit of the hearing apparatus to be achieved in a simple and efficient manner.

Accordingly a molding structure is supplied, which represents a model for the direct shaping of an otoplastic for a hearing apparatus. The molding structure has a sealing element, which can be positioned in the auditory canal and which, when inserted into the auditory canal, has a side facing an outlet of the auditory canal and a molding mass, which, when inserted into the auditory canal, comes up against the side of the sealing element facing the outlet of the auditory canal and at least partially fills the auditory canal. The molding mass and the sealing element are connected to form the model and the sealing element has a shape that is identical to a corresponding structural part of the hearing apparatus.

The molding structure is formed by first inserting a corresponding sealing element into the auditory canal. The sealing element is preferably positioned in the bony part of the auditory canal, in particular behind the second bend of the auditory canal. Instead of the piece of cotton wool or cotton generally used, in this instance a sealing element is used, which represents, in shape, a part of the hearing apparatus. The sealing element, or its equivalent, as it were, can be a corresponding earpiece or dome, which is used to hold a hearing device component. Thus for example the sealing element in question can be used to hold a sound tube, which is coupled to a loudspeaker of the hearing apparatus. Once the sealing element has been positioned in the auditory canal, an appropriate molding mass, for example an addition cross-linking silicone rubber, is inserted into the auditory canal. The molding mass is generally inserted into the auditory canal in the liquid state. When the molding mass has hardened, the sealing element is removed from the auditory canal together with the molding mass. The hardened molding mass is then captured together with the sealing element, generally using an appropriate scanner, which captures data relating to the three-dimensional shape of the molding mass and sealing element. The captured data is used to manufacture a corresponding otoplastic for the hearing apparatus. The otoplastic is produced in particular for the components of the hearing apparatus, which are worn directly in the auditory canal. Also use of the sealing element allows a molding structure to be created, which extends deeper into the auditory canal, since the sealing element is part of the molding structure.

In one embodiment of the invention the sealing element has a fastening element, on which a coupling element for connecting the sealing element to the molding mass is disposed. The sealing element generally has a corresponding fastening element, on which a coupling element can be positioned. The coupling element can be connected for example by an appropriate plug-type or snap-fit connection to the fastening element. The coupling element can be configured for example as a corresponding sleeve or pin, made in particular of a plastic material. The coupling element makes it easier for the hearing device acoustician or physician to position the sealing element inside the auditory canal. The position and alignment of the sealing element in the auditory canal are thus determined exactly with the aid of a corresponding tool. After the molding mass has been inserted and hardened, the molding mass also encloses the coupling element, which is connected to the sealing element, thereby increasing the mechanical strength of the connection between molding mass and sealing element.

The sealing element is preferably made of a plastic foam, in particular a polyurethane foam. Because the sealing element is made of appropriate plastic foam, it is particularly flexible and adapts particularly well to the shape of the auditory canal. The plastic foam is preferably configured in such a manner that it can be captured optically by a corresponding three-dimensional scanner. A corresponding sealing element can also be produced particularly easily and at low cost using such plastic foam. Finally it is possible to provide a corresponding cutout in the plastic foam particularly easily, in which a corresponding component of the hearing apparatus, for example a sound tube, can be positioned and fastened.

Also provided according to the invention is a hearing apparatus, which can be worn in an auditory canal, having an otoplastic, the shape of which is configured according to the molding structure at least in parts, the otoplastic being connected to the sealing element. After the above-mentioned molding structure has been produced, a corresponding otoplastic, which corresponds to the outer measurements and dimensions of the molding structure at least in parts, is manufactured. The molding structure can thus be used to make a corresponding mold for the hearing apparatus, for example an ear pod or a corresponding housing. The otoplastic is generally made of an appropriate plastic material. The otoplastic is connected to a part of the hearing device that has the same dimensions and shape as the sealing element, which was used previously to produce the molding structure. This allows the hearing apparatus to be tailored particularly exactly to the auditory canal, since the shape of the molding mass together with the sealing element is taken into account when producing the otoplastic.

In a further embodiment the otoplastic and the sealing element, or the part of the hearing device that corresponds with the sealing element, are connected to a connecting element, which is coupled pivotably to a fastening element. The sealing element preferably has a corresponding fastening element, on which a corresponding coupling element can be disposed during production of the molding structure. A corresponding connecting element of the hearing apparatus can be coupled to the fastening element. It is thus possible to establish a mechanical connection between the hearing apparatus and the sealing element in a particularly simple and effective manner. The connection between the fastening element and the connecting element is preferably supported in a pivotable manner. The hearing apparatus together with the part corresponding to the sealing element can thus be inserted into the auditory canal with a particularly close fit. This ensures an adequate level of wearer comfort for the user.

The connecting element is preferably configured to transmit sound between the otoplastic and the sealing element. The connecting element can be configured for example as a corresponding sound tube, which transmits acoustic signals from a corresponding loudspeaker disposed in the otoplastic or in the housing. The connecting element or a corresponding sound tube is fastened in the part corresponding to the sealing element here, for example in a corresponding cutout.

In one preferred embodiment the sealing element and/or the part corresponding to the sealing element has a through opening, which extends from an end face of the sealing element facing away from the otoplastic to the connecting element. If the connecting element is embodied as a sound tube, the sealing element or the part has a corresponding through hole, through which the acoustic signals can be transmitted to the eardrum. It is also possible for corresponding signals to be transmitted directly from a loudspeaker to the eardrum through the through opening of the part corresponding to the sealing element.

Finally provided according to the invention is a method for producing a molding structure, which represents a model for the direct shaping of an otoplastic for a hearing apparatus, by positioning a sealing element in the auditory canal, the sealing element, when inserted into the auditory canal, having a side facing the outlet of the auditory canal, inserting a molding mass into the auditory canal, so that the molding mass comes up against the side of the sealing element facing the outlet of the auditory canal and at least partially fills the auditory canal, and removing the molding mass and the sealing element from the auditory canal, the molding mass and the sealing element being connected to one another to form the model. The sealing element has the exact shape of the corresponding part of the hearing apparatus.

The developments described above in conjunction with the inventive molding structure can be applied in the same such manner to the inventive method for producing such a molding structure.

Other features which are considered as characteristic for the invention are set forth in the appended claims.

Although the invention is illustrated and described herein as embodied in a molding structure for a hearing apparatus, a hearing apparatus and a method for producing the molding structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below represent preferred embodiments of the present invention.

Figure 2:
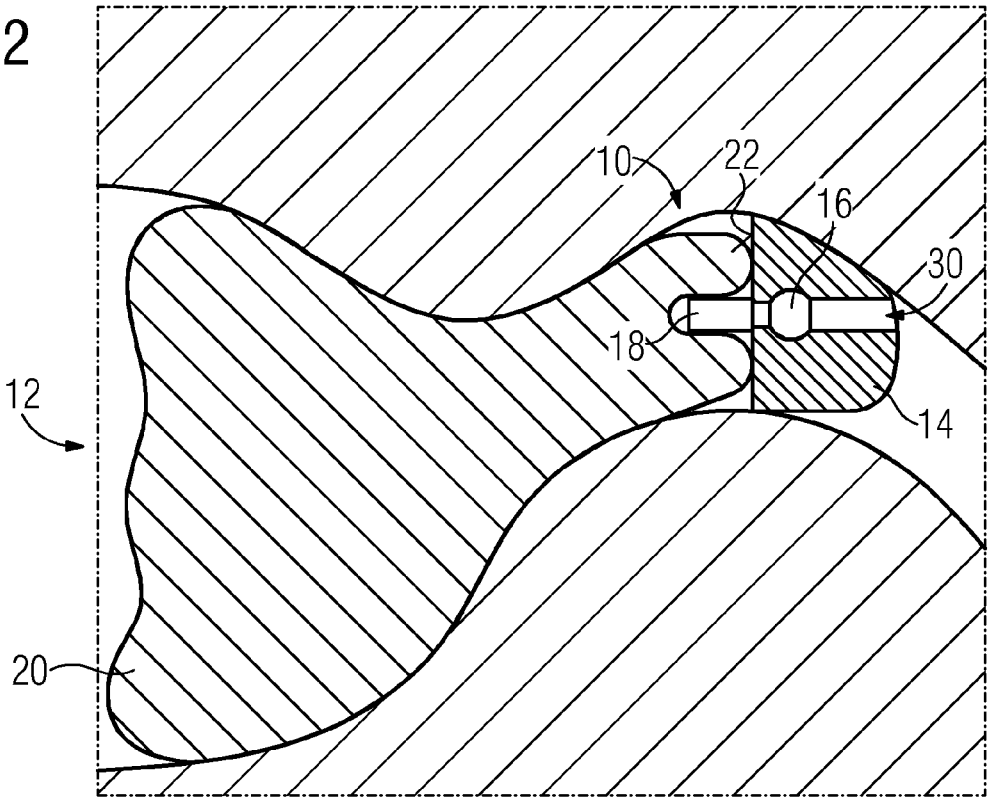
FIG. 2 is a diagrammatic, sectional view of a molding structure, which is disposed in an auditory canal according to the invention.

Referring now to the figures of the drawing in detail and first, particularly, to FIG. 2 thereof, there is shown a schematic, sectional representation of a molding structure 10, which is disposed in an auditory canal 12. The molding structure 10 contains a sealing element 14, which is positioned in the auditory canal 12. The sealing element 14 is preferably disposed in a bony part of the auditory canal 12, in particular behind a second bend of the auditory canal 12. The sealing element 14 contains a fastening element 16, on which a coupling element 18 is disposed. The coupling element 18 is detachably connected for example by way of an appropriate plug-type or snap-fit connection to the fastening element 16. The coupling element 18 makes it easier for the hearing device acoustician or the physician to position the sealing element 14 in the auditory canal 12. A corresponding tool can be used to position and align the sealing element particularly exactly in the auditory canal with the aid of the coupling element 18.

When the sealing element 14 has been positioned in the auditory canal 12, a corresponding molding mass 20 is inserted into the auditory canal 12. The molding mass 20 is for example an appropriate addition cross-linking silicone rubber, which is inserted in the liquid state and hardens after a short time at room temperature. After insertion and hardening the molding mass 20 is disposed in the auditory canal 12 in such a manner that it comes up against a side 22 of the sealing element 14 facing the outlet of the auditory canal 12. The hardened molding mass 20 at least partially fills the auditory canal 12, so that the exact shape of the auditory canal 12 is reproduced by the hardened molding mass 20. The molding mass 20 and sealing element 14 together form a model here, for the direct shaping of an otoplastic 24 of a hearing apparatus 26. Such a hearing apparatus 26 is illustrated for example in FIG. 3.

In the present instance the molding mass 20 together with the sealing element 14 is captured optically using a three-dimensional scanner. The captured scanner data can be used to produce the corresponding otoplastic 24 for the hearing apparatus 26. After scanning the sealing element 14 can be detached from the coupling element 18. The sealing element 14 has the exact same shape (e.g., the outer dimensions) as its corresponding part of the hearing apparatus 26. The shape of the sealing element 14 is that of an earpiece or dome, which can be used for example to hold corresponding components of the hearing apparatus 26. For example a corresponding sound tube can be held by the part corresponding to the sealing element 14. The sealing element 14 is preferably made of plastic foam, in particular a polyurethane foam. This material is particularly elastic and can thus be disposed in the auditory canal 12 with a particularly close fit. The part of the hearing device corresponding to the sealing element 14 may consist of the same materials. The sealing element 14 is thus used on the one hand to produce a corresponding molding structure 10 and serves at the same time as an exact mold of a part of the hearing apparatus 26.

Figure 1:
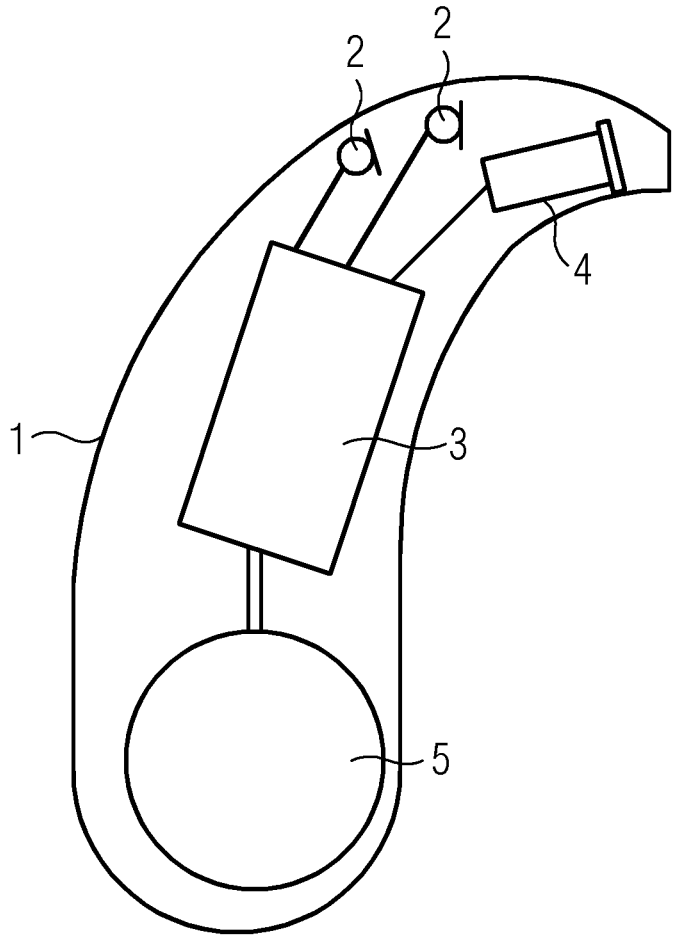
FIG 1 (Prior art)
FIG. 1 is an illustration of a basic structure of a hearing device according to the prior art.
Figure 3:
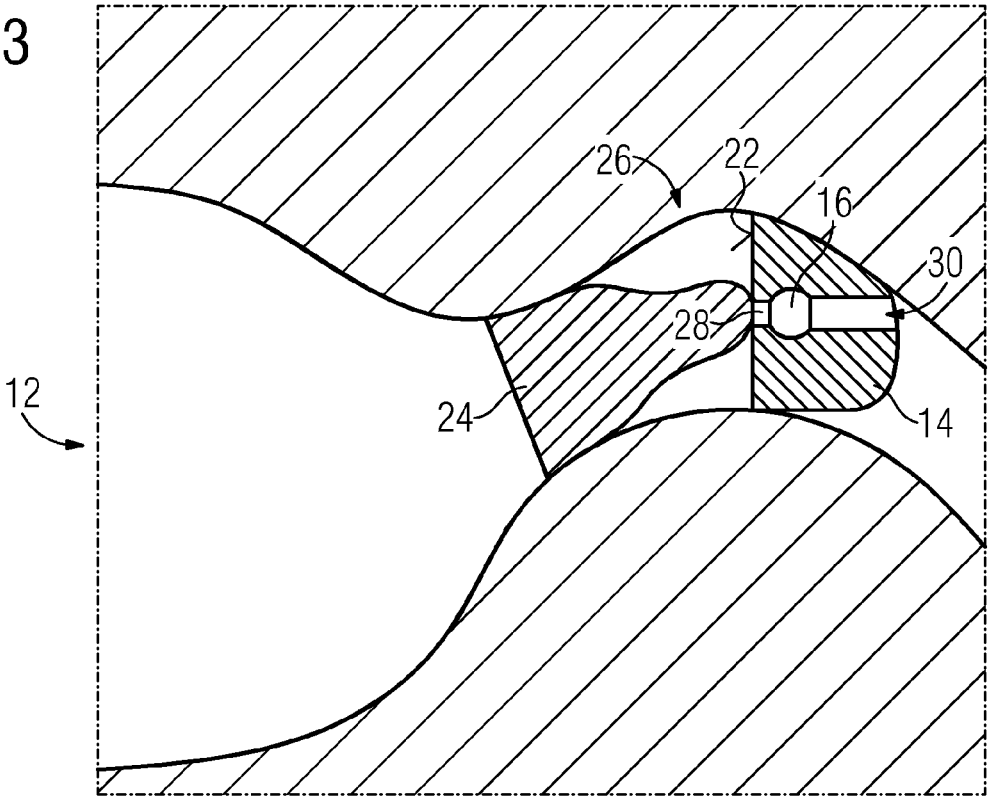
FIG. 3 is a diagrammatic, sectional view of a hearing apparatus, which is disposed in the auditory canal.

FIG. 3 shows the hearing apparatus 26, wherein the part of the hearing device corresponding to the sealing element 14 and the corresponding otoplastic 24 are positioned in the auditory canal 12. The otoplastic 24 is generally made of a plastic material and can form a housing of the hearing apparatus 26. The otoplastic 24 is connected by a corresponding connecting element 28 to the fastening element 16 of the sealing element 14. In particular the otoplastic 24 is connected pivotably to the part corresponding to the sealing element 14 by way of the fastening element 16. It is thus possible to position the hearing apparatus 26 particularly simply and with a close fit in the auditory canal 12. The connecting element 28 can be configured for example as a corresponding sound tube, which can be used to transmit acoustic signals between the otoplastic 24 and the sealing element 14. Present inside the otoplastic 24 are the individual components of the hearing apparatus 26, as illustrated for example in FIG. 1. The part of the hearing device that corresponds to the sealing element 14 also has a corresponding opening 30, by which acoustic signals and sound can be transmitted from the connecting element 28 to an eardrum (not illustrated here).

The invention claimed is:

1. A molding structure representing a model for a direct shaping of an otoplastic for a hearing apparatus, the molding structure comprising:

a sealing element for positioning in an auditory canal, and when inserted into the auditory canal, having a side facing an outlet of the auditory canal, and a molding mass, which, when inserted into the auditory canal, comes up against said side of said sealing element facing the outlet of the auditory canal and at least partially fills the auditory canal, said molding mass and said sealing element are connected to form the model and said sealing element having a shape identical to a respective part of the hearing apparatus, wherein said sealing element has a fastening element, on which a coupling element for connecting said sealing element to said molding mass is disposed.

2. The molding structure according to claim 1, wherein said sealing element is made of plastic foam.

3. The molding structure according to claim 1, wherein said sealing element is made of polyurethane foam.

4. A hearing apparatus for wearing in an auditory canal, the hearing device comprising: an otoplastic; a molding structure representing a model for a direct shaping of said otoplastic, said molding structure containing a sealing element for positioning in the auditory canal, and when inserted into the auditory canal, having a side facing an outlet of the auditory canal, said otoplastic connected to a part of the hearing apparatus corresponding to said sealing element, a shape of said otoplastic being configured at least in parts according to said molding structure; and a connecting element; wherein the part of the hearing apparatus corresponding to said sealing element has a fastening element; and wherein said otoplastic and said part are connected to said connecting element, which is coupled pivotably to said fastening element of said part.

5. The hearing apparatus according to claim 4, wherein said connecting element is configured to transmit sound between said otoplastic and said part of the hearing apparatus corresponding to said sealing element.

6. The hearing apparatus according to claim 4, wherein said sealing element has a through opening formed therein, which extends from an end face of said sealing element facing away from said otoplastic to said connecting element.

7. A method for producing a molding structure representing a model for a direct shaping of an otoplastic for a hearing apparatus, which comprises the steps of:

positioning a sealing element in an auditory canal, the sealing element, when inserted into the auditory canal, having a side facing an outlet of the auditory canal;

inserting a molding mass into the auditory canal, so that the molding mass comes up against the side of the sealing element facing the outlet of the auditory canal and at least partially fills the auditory canal;

removing the molding mass and the sealing element from the auditory canal; and connecting the molding mass and the sealing element to one another to form the model, wherein the sealing element defines a shape of a part of the hearing apparatus.

8. The method according to claim 7, which further comprises:

scanning the model resulting in captured data; and forming the otoplastic from the captured data.

* * * * *